US007229149B2

(12) United States Patent
Wotton et al.

(10) Patent No.: US 7,229,149 B2
(45) Date of Patent: Jun. 12, 2007

(54) SERVICE STATION AND METHOD FOR SERVICING DRUM PRINTER

(75) Inventors: Geoff Wotton, Battleground, WA (US); John A. Barinaga, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 269 days.

(21) Appl. No.: 10/638,508

(22) Filed: Aug. 11, 2003

(65) Prior Publication Data

US 2005/0035990 A1 Feb. 17, 2005

(51) Int. Cl.
*B41J 2/165* (2006.01)

(52) U.S. Cl. ..... 347/33; 347/29; 347/30

(58) Field of Classification Search ..... 347/22–36
See application file for complete search history.

(56) References Cited

U.S. PATENT DOCUMENTS 4,207,578 A * 6/1980 Marinoff ..... 347/35
5,184,147 A 2/1993 MacLane et al.
5,534,897 A 7/1996 Anderson
6,154,232 A 11/2000 Hickman et al.
6,276,268 B1 8/2001 Takahashi et al.
6,585,347 B1 7/2003 Johnson
2003/0081055 A1 5/2003 Wotton
2004/0174408 A1* 9/2004 Johnson ..... 347/22
2005/0024421 A1* 2/2005 Barinaga et al. ..... 347/22

FOREIGN PATENT DOCUMENTS

EP 0914952 5/1999

* cited by examiner

*Primary Examiner*—Stephen Meier
*Assistant Examiner*—Ly T Tran

(57) ABSTRACT

A method for servicing a printhead includes moving the printhead along a first path away from a printing position adjacent a drum to a service position away from the drum, moving a service station carrying a printhead service element through an arc-shaped second path from a rest position to a servicing position, and conducting a service operation with the service element on the printhead at the service position.

41 Claims, 6 Drawing Sheets

SERVICE STATION AND METHOD FOR SERVICING DRUM PRINTER

BACKGROUND

Drum printers are a type of printing system including a rotating drum for moving media under a printing device such as an array of fluid ejecting elements. The fluid ejecting elements can include inkjet printheads, and typically may need servicing from time to time. Accessing the printheads for servicing presents a problem.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
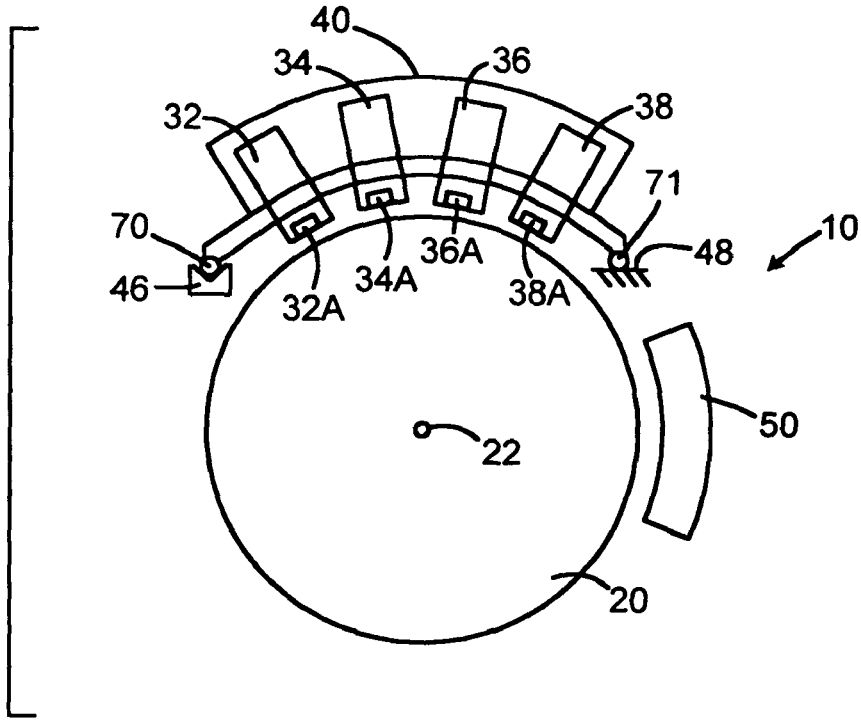
FIG. 1 is a schematic illustration of an exemplary embodiment of a drum printer employing a service station, with the print bars in printing positions.

In the following detailed description and in the several figures of the drawing, like elements are identified with like reference numerals.

FIG. 1 is a schematic illustration of an exemplary embodiment of a drum printer 10 comprising a rotatable drum 20, with a plurality of print bars 32, 34, 36, 38 disposed above the drum. The drum is mounted for rotation about a drum axis 22. Each print bar comprises in this exemplary embodiment a page wide array (PWA) 32A, 34A, 36A, 38A of printheads or pens. In this exemplary embodiment the printheads are inkjet printheads, each comprising an array of fluid ejecting nozzles. In an exemplary embodiment, each print bar supports a plurality of printheads, disposed along the width of the page. Moreover, each print bar can support printheads of the same color in an exemplary embodiment. For example, printhead array 32A can be yellow ink ejection devices, printhead array 34A can be black ink ejection devices, printhead array 36A can be cyan ink ejection devices, and printhead array 38A can be magenta ink ejection devices. In another embodiment, a print bar can have printheads with multiple colors of ink.

In this exemplary drum printer configuration, the printer loads the print medium onto the rotating drum, and holds the print medium tightly against the drum surface, e.g. by a vacuum system. Ink is ejected onto the surface of the print medium as it passes underneath the print bars to form the image. The print medium is unloaded off the drum after completion of the print job. In an exemplary embodiment, the print bars are positioned with the printhead nozzle arrays very close to the surface of the drum in a printing position to provide high print quality of the printed output.

Printhead servicing is performed, e.g. to cap the nozzle arrays, wipe the arrays or actuation of the printheads to eject ink into a spittoon. To accommodate servicing the printheads, in an exemplary embodiment, the print bars are secured in a ganged fashion to a print bar frame structure 40. In an exemplary embodiment, the frame structure 40 is a structure having mounting locations to which each of the print bars are secured. The frame structure 40 is movable between a printing position and a service position, where the printheads are positioned away from the drum surface. In this exemplary embodiment, a generally arc-shaped service station 50 is provided to perform servicing on the printheads when the printheads are positioned away from the drum surface. FIG. 1 shows the print bar frame and the printheads in a printing position, and the service station 50 in a home or rest position.

Figure 2:
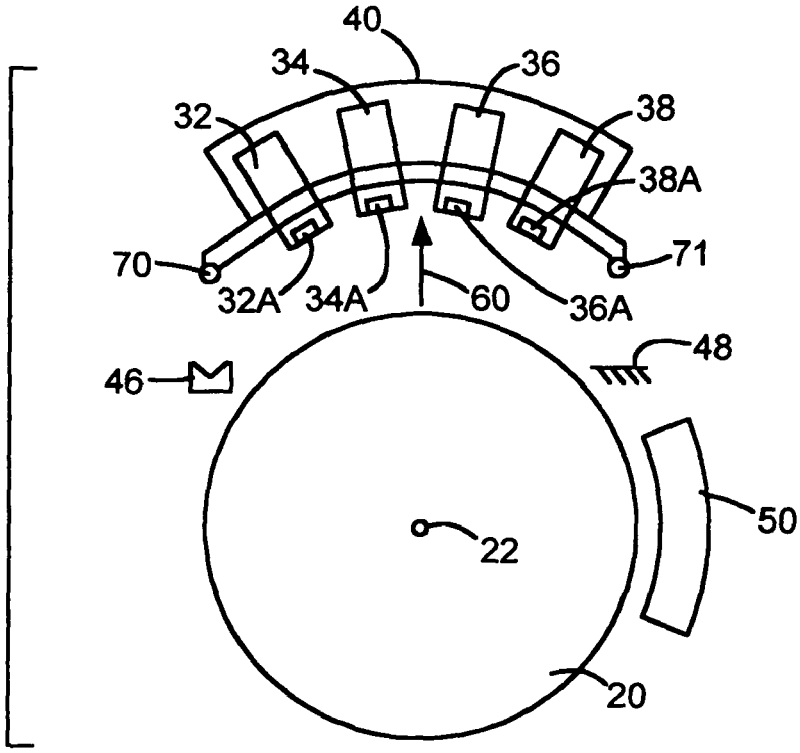
FIG. 2 is a schematic illustration of the drum printer of FIG. 1, with the print bars moved to a service position.
Figure 3:
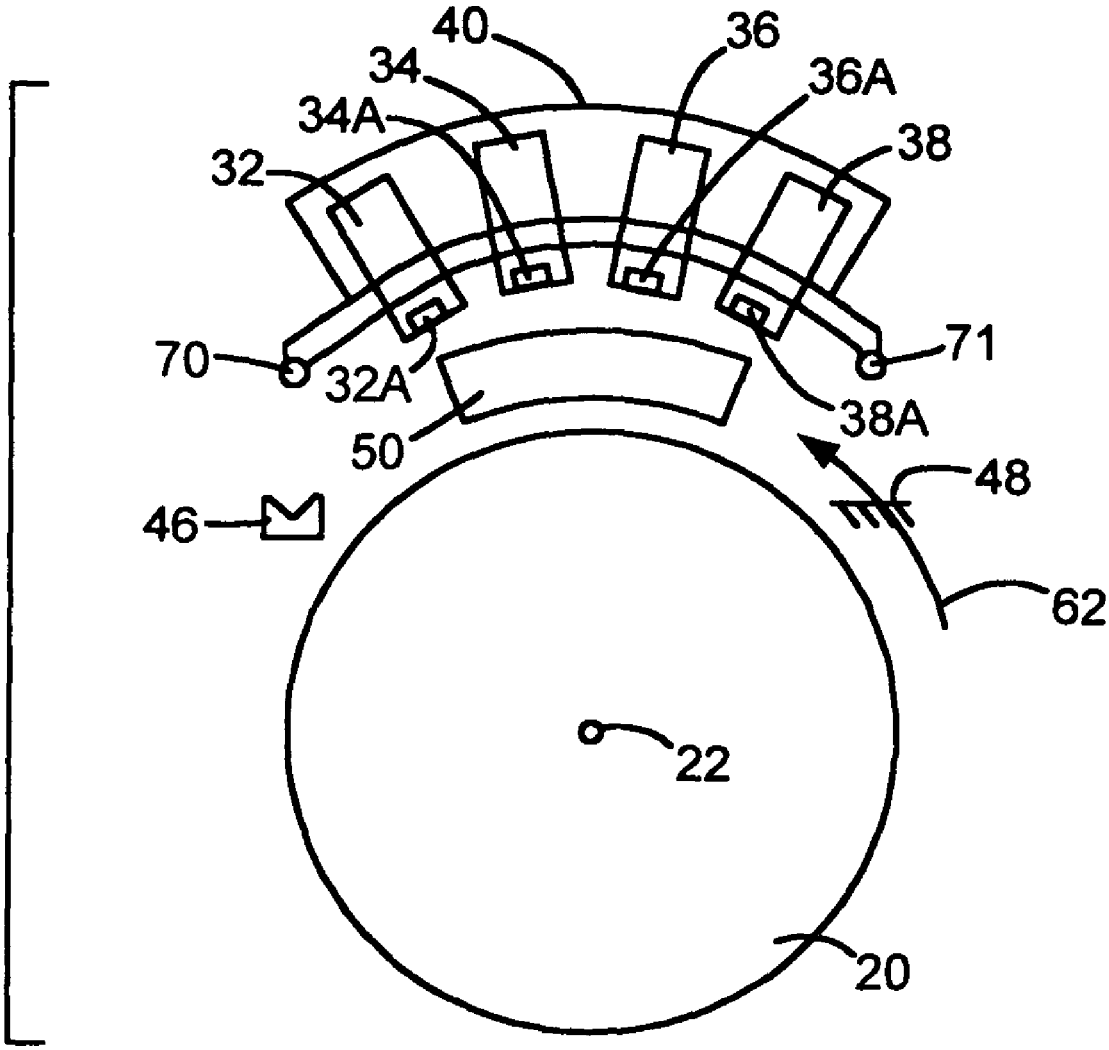
FIG. 3 is a schematic illustration of the drum printer as in FIG. 2, with the service station rotated into a servicing position.

When it is time for the printheads to be serviced, the print bar frame structure 40 and the print bars 32, 34, 36, 38 are moved radially away from the center of the drum, following a constrained first path 60 (FIG. 2) away from the drum surface to a print bar service position that allows access to the printheads. FIG. 2 illustrates the print bars and frame structure 40 after they have been moved to the servicing position, with the service station 50 still in a home position. Now the service station is rotated about an arc-shaped second, service path 62 (FIG. 3) around the drum surface from the home position (FIGS. 1 and 2) to a servicing position. FIG. 3 shows the service station 50 after it has been moved into the servicing position. The printheads can now be serviced, e.g. cleaned or capped, by the service station 50.

When the service station has finished servicing the printheads, it may be moved away from the servicing position, e.g. returned along the path 62 to the home position, and the frame structure 40 is lowered to return the print bars to the printing position adjacent the drum surface. The printer can now resume printing, and the service station can do necessary maintenance of the servicing components, e.g. scrape the wipers off onto a scraper component.

Accurate positioning of the frame structure 40 relative to the drum surface is provided by registration surfaces 70, 71 and datums 46, 48. The surfaces 70, 71 are ball or curved surfaces. The datum 46 is a V-block structure, which receives registration surface 70 in its notch with the print bar structure in the printing position. The second registration surface fits against the surface 48. In an exemplary embodiment, the force of gravity holds the registration surfaces against the datums. For some applications, there will be a set of registration surfaces 70, 71 and fixed datums 46, 48 on each of the opposite sides of the drum. This would allow clearance for the service station to move from the home position to the servicing position without striking the datums.

The arc-like shape of the service station in an exemplary embodiment results in a relatively compact size, and provides a simple but effective service station architecture.

In an exemplary embodiment, a separate motor can be employed to move the service station between the rest position and the service position. Similarly, a separate motor can be employed to move the print bars and frame between the printing position and the service position. In an alternate embodiment, the service station can be moved between the rest position and the service position by the drum, without a separate motor for this motion of the service station. The service station in this alternate embodiment is engaged by the drum, which rotates to carry the service station to the service position. In an exemplary embodiment, the print bars and the support frame can be cam operated, wherein the service station acts as the cam that lifts the print bars when the service station is moved to the service position for servicing. Thus, in an alternate embodiment, no additional motors are employed to move the service station into position or lift the print bars into the servicing position.

Figure 4:
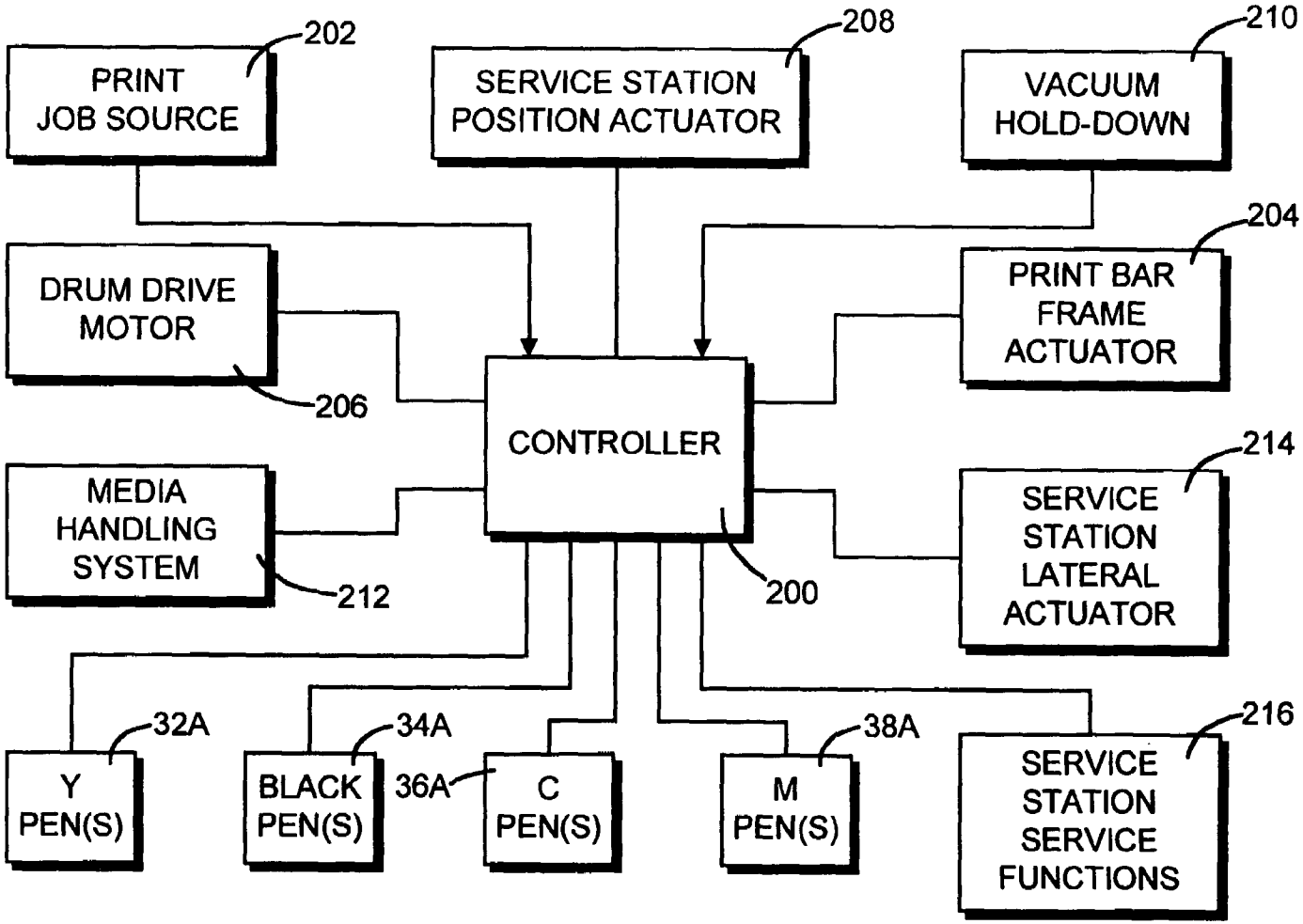
FIG. 4 is a schematic control block diagram of elements of the drum printer of FIGS. 1–3.

FIG. 4 is a schematic block diagram of the control system for the printer of FIGS. 1–3. A controller 200 such as a microcomputer or ASIC receives print job commands and data from a print job source 202, which can be a personal computer, scanner, digital camera or other known source of print jobs. The controller acts on the received commands to activate a media handling system 212 to load a print medium onto the drum 20 and activate the vacuum hold-down system 210 to hold the print medium against the drum surface. The drum drive motor 206 is commanded by the controller to position the drum 20 for commencement of a print job. Firing pulses are sent to the printheads comprising the pens 32A, 34A, 36A, 38A to eject ink droplets onto the medium surface. The controller is programmed to advance the drum past the print bars. The media handling system unloads the print medium from the drum upon completion of printing.

When it is time for a service operation, in one exemplary embodiment, a print bar frame actuator 204, e.g. a motor, can be activated by the controller to move the print bar frame structure from the printing position along path 60 to the service position. A service station position actuator 208, e.g. a motor can then be activated to rotate the service station 50 along path 62 to the service position. This might be done using a pivot arm with a ring gear attached there, the gear driven by a motor. Alternatively, for the case in which the service station is moved by the drum, there is an actuator device, e.g. a solenoid, which couples the service station to the drum so that drum motion also results in rotational movement of the service about path 62. For this alternate embodiment, as the service station approaches the print bar frame, a cam on the station engages a print bar surface, causing the print bar frame structure to move upwardly along the constrained path 60.

Once the service station and print bar frame structure have reached their respective servicing and service positions, the controller actuates the service station functions 216, e.g. wiping and capping. In an exemplary embodiment, the service station service elements, e.g. the wipers and caps can be moved laterally, by service station lateral actuator 214 to perform wiping and capping functions. In an exemplary embodiment, the actuator 214 can be a motor driven gear train, with rack and pinion gearing. When it is time to commence printing operations, the service station is moved to the rest position, and the print bar frame structure with the print bars is returned to the printing position.

Figure 5:
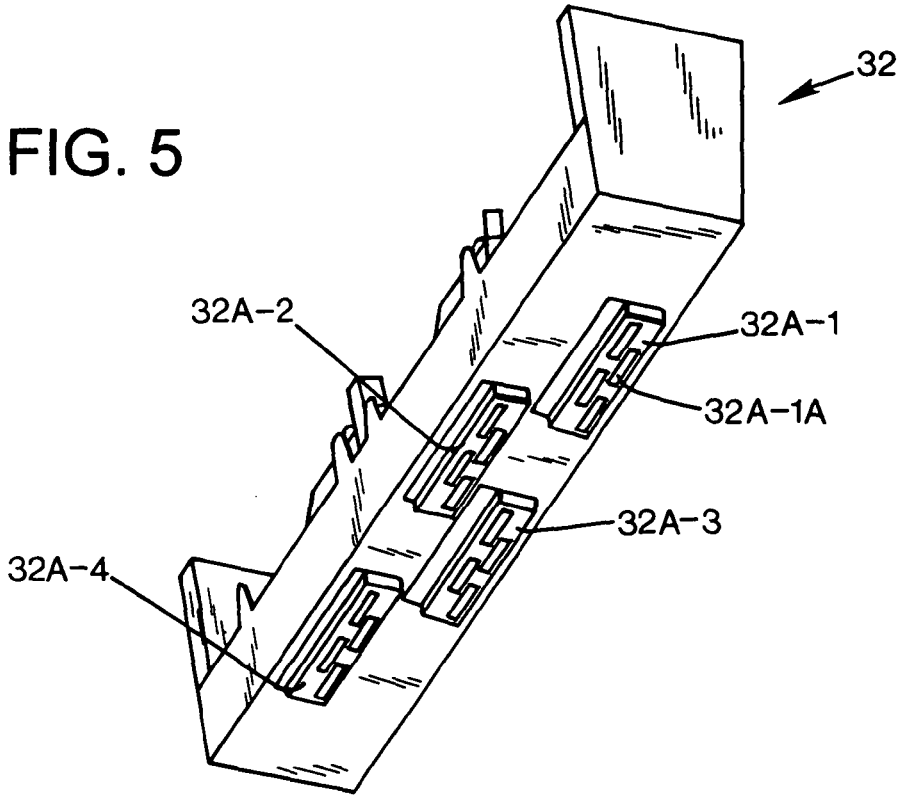
FIG. 5 is an isometric view of an exemplary embodiment of a print bar.

FIGS. 5–9 illustrate exemplary embodiments of the print bar, the service station and components for servicing the service station. FIG. 5 is an isometric view of an exemplary print bar 32, which has mounted therein four printhead cartridges or modules 32A-1, 32A-2, 32A-3, 32A-4, each with an associated printhead nozzle array. In this exemplary embodiment, each cartridge includes a set of four nozzle arrays which are arranged in a staggered relationship. For example, printhead 32A-1 includes an array 32A-1A of fluid ejecting nozzles. The printhead cartridges are arranged along an extent of the print bar in a distributed, staggered manner so as to provide continuous coverage along the extent of a print zone in this exemplary embodiment for a page wide array. In an exemplary embodiment, each of the print cartridges can be fed with ink through flexible tubes (not shown) running to ink supplies located off the print bar. Alternatively, the print cartridges can include on-board ink reservoirs (not shown) with capacity sufficient to print one or more print jobs.

Figure 6:
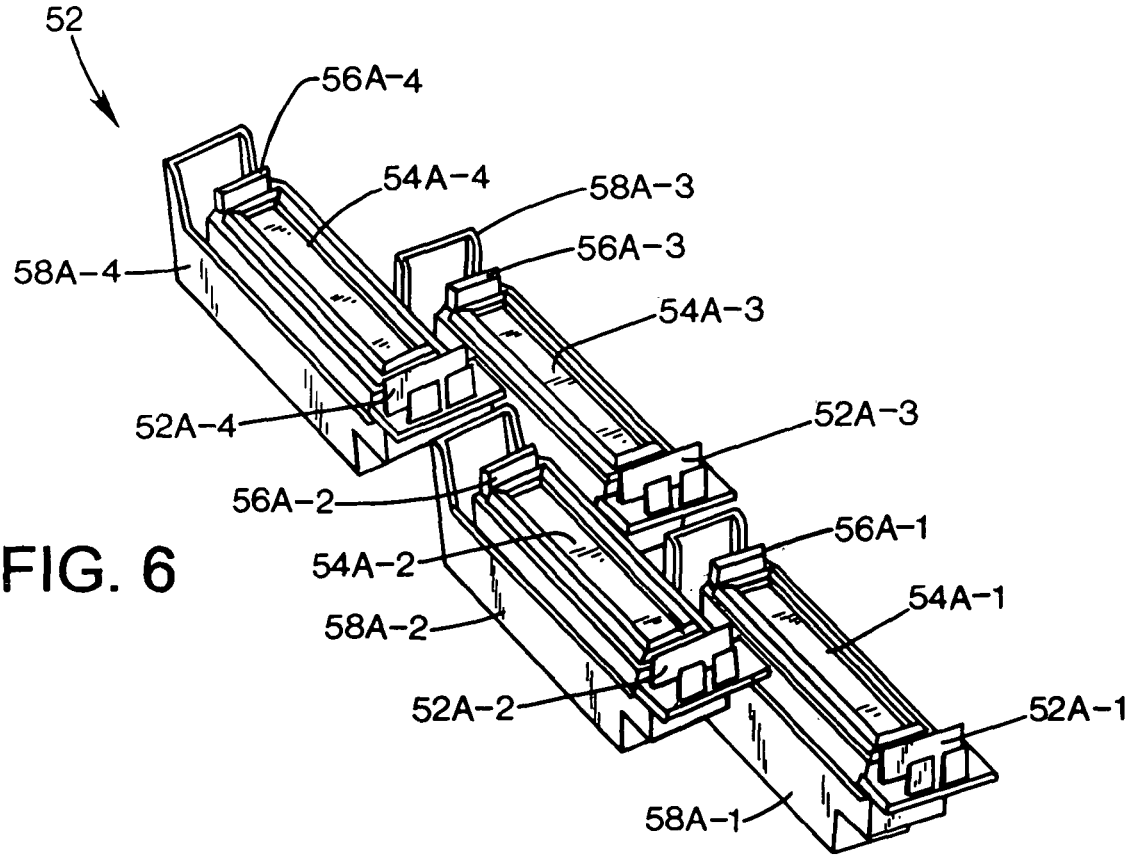
FIG. 6 is an isometric view of an exemplary embodiment of a cap and wiper array adapted to service the print bar of FIG. 5.

FIG. 6 is an isometric view of a cap and wiper array 52 adapted to service the print bar 32 of FIG. 5. The array 52 includes four sets of wipers and caps, one for each printhead on the print bar. Thus, the array 52 includes wiper and cap 52A-1, 54A-1 for servicing printhead 32A-1, wiper and cap 52A-2, 54A-2 for servicing printhead 32A-2, wiper and cap 52A-3, 54A-3 for servicing printhead 32A-3, wiper and cap 52A-4, 54A-4 for servicing printhead 32A-4. Each wiper and cap set is mounted on a corresponding sled structure 58A-1, 58A-2, 58A-3, 58A-4. Each wiper and cap is positioned appropriately on the service station to engage its corresponding printhead during a service operation.

Figure 7:
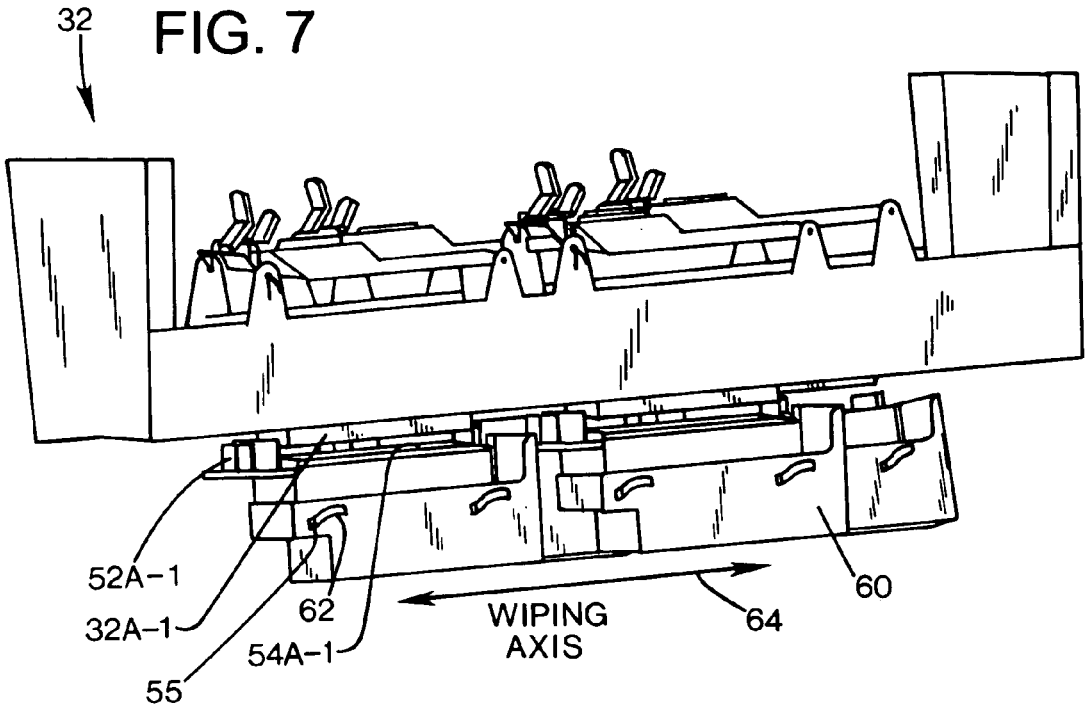
FIG. 7 is an isometric view showing the cap and wiper array of FIG. 6 positioned underneath the print bar in a servicing position.

FIG. 7 is an isometric view showing the cap and wiper array 52 underneath the print bar 32 in the servicing position. The sled structures are mounted in a service station housing structure 60 (FIG. 7). To wipe the printhead nozzle arrays, the wipers are moved to the right (in the sense of FIG. 7) along wiping path 64 until the entire printhead nozzle array for each wiper is wiped, then the wipers are moved back to their original positions in a bidirectional wiping movement. In this exemplary embodiment, the wiping path is parallel to the axis 22 of rotation of the drum 20. Since a separate wiper is provided for each printhead module in this exemplary embodiment, each wiper travels the length of one module or printhead array set, and not across the full width of the print bar.

To cap the nozzle arrays of the printheads, the print bar is moved toward the surface of the drum slightly, and the caps are moved in a direction perpendicular to the wiping axis into the capping position to store the printheads for periods of nonuse. A sled feature adjacent each cap engages the print bar, stopping further lateral movement of the sled structures relative to the print bar and causes the sled structures to engage respective ramp surfaces, lifting the caps into the capping position. Features 56A-1, 56A-2, 56A-3, 56A-4 (FIG. 6) protrude upwardly adjacent an end of the respective caps opposite the cap end adjacent the wiper. Each sled structure is supported on pins 55 which ride on ramp surfaces 62 formed by openings formed in the side walls of the housing structure, thus permitting some constrained movement of the sled structures within the housing structure.

Figure 8:
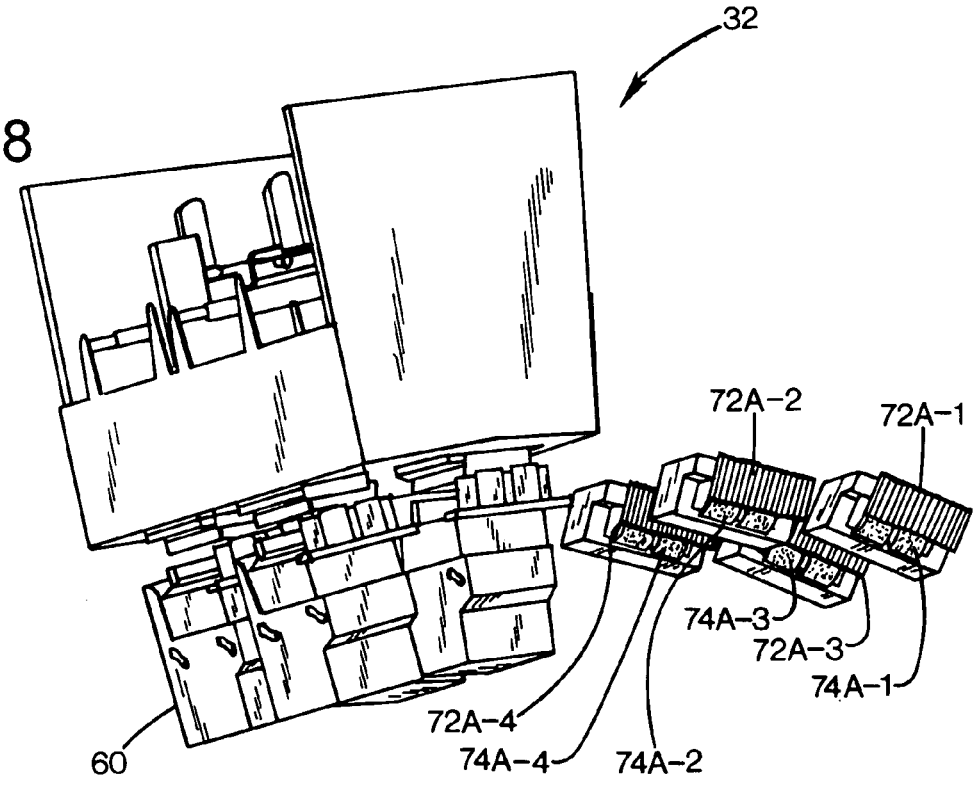
FIG. 8 is an isometric view of the print bar of FIG. 5 and the service station array of FIG. 6 in the service position, also showing an exemplary embodiment of service station cleaning elements.
Figure 9:
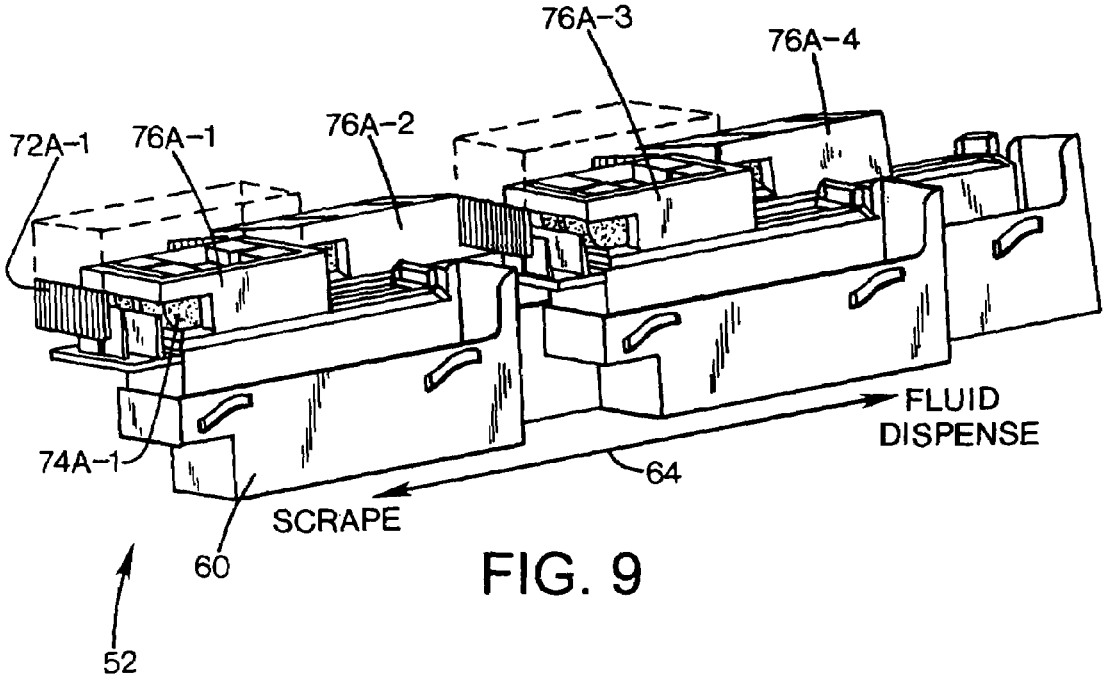
FIG. 9 shows the cap and wiper array rotated to a position underneath the scrapers and wipe assist fluid dispense components, in accordance with an example embodiment.

FIG. 8 is an isometric view of the print bar 32 and the service station array in the service position, but also showing an exemplary embodiment of service station cleaning components comprising a service station maintenance system. These elements are arranged in sets, each including a scraper for scraping the corresponding wiper, and a wipe assist fluid dispenser for dispensing a wipe assist fluid onto the wiper. An exemplary scraper and wipe assist fluid dispenser set includes scraper 72A-1 and the wipe assist fluid dispenser comprising a wick structure 74A-1 in fluid communication with a fluid reservoir 76A-1 (FIG. 9). In this embodiment, the scraper and fluid dispense components are stationary elements, located radially around the drum between the service station rest position and the service position.

When it is time to scrape or to apply wipe assist fluid to the wipers, the service station is rotated radially around the drum to position the wipers underneath the scrapers and the wipe assist fluid dispensers at a service station maintenance position. This is illustrated in FIG. 9, with the cap and wiper array rotated to a position underneath the scrapers and wipe assist fluid dispense components. To scrape the wipers, the wipers are moved laterally to the left (in the sense of FIG. 9) along path 64 in a scrape direction to engage with corresponding ones of the scrapers 72A-1, 72A-2, 72A-3, 72A-4, and then back to the right in a bidirectional scrape cycle. To apply wipe assist fluid to the wipers, the wipers are moved to the right along path 64 in a fluid dispense direction to engage with the wipe assist fluid dispensers.

The scrapers 72A-1, 72A-2, 72A-3, 72A-4 in an exemplary embodiment are blade elements which scrape debris from the wipers as the wipers are moved along the scrape direction. The scrapers can be fabricated of an absorptive material, or of a relatively rigid material.

The wipe assist fluid dispensers in an exemplary embodiment include a wick structure 74A-1, 74A-2, 74A-3, 74A-4 (FIG. 8) in fluid communication with a corresponding fluid reservoir 76A-1, 76A-2, 76A-3, 76A-4 (FIG. 9). The wick is a capillary member for applying a capillary force to draw a wipe assist fluid, e.g. polyethylene glycol (PEG) or glycerol from the reservoir.

With this exemplary service station architecture, the printhead nozzle arrays can be wiped and capped by the service station, and the wipers can also be scraped clean or have wipe assist fluid applied. Each printhead or module has its own associated wiper, cap, scraper and wipe assist fluid dispenser. Since the wiping mechanism has only to travel the length of one printhead or module, its stroke is reduced in relation to a system that wipes the entire print bar with one assembly. Wiping speed is also increased, since all wipers are moved simultaneously.

Although the foregoing has been a description and illustration of specific embodiments of the invention, various modifications and changes thereto can be made by persons skilled in the art without departing from the scope and spirit of the invention as defined by the following claims.

What is claimed is:

1. A method for servicing a printhead comprising:

moving the printhead along a first path away from a printing position adjacent a drum to a service position away from the drum;

moving a service station carrying a printhead service element through an arc-shaped second path from a rest position to a servicing position, wherein said arc shaped second path is concentric to a surface of the drum;

conducting a service operation with the service element on the printhead at the service position.

2. The method of claim 1, further comprising:

moving the service station to a station maintenance position; and performing a maintenance operation on the printhead service element.

3. The method of claim 2, wherein the station maintenance position is disposed on said second path at a location between said rest position and said servicing position.

4. The method of claim 2, wherein said printhead service element comprises a wiper, and said performing a maintenance operation on the printhead service element comprises: scraping the wiper to remove debris or contaminants.

5. The method of claim 2, wherein said printhead service element comprises a wiper, and said performing a maintenance operation on the printhead service element comprises:

scraping the wiper to remove debris or contaminants.

applying a wipe assist fluid to the wiper.

6. The method of claim 2, wherein said performing a maintenance operation on the printhead service element comprises:

moving the service station along a scrape path to bring the wiper in contact with a scraper.

7. The method of claim 6, wherein said scrape path is a linear path parallel to an axis of said drum.

8. The method of claim 1, further comprising:

moving the service station along said second path away from said servicing position;

moving the printhead along the first path back to the printing position to reposition the print bars for printing operations.

9. The method of claim 1, wherein said moving the printhead along the first path back to the printing position includes engaging a fixed datum with a registration surface to position the printhead at the printing position.

10. The method of claim 1, wherein said moving the printhead away from the printing position comprises:

moving the printhead in a linear path extending radially away from a center axis of the drum.

11. The method of claim 1, wherein said service element comprises a wiper element for wiping a nozzle array of said printhead, and said conducting said service operation comprises:

moving the service station along a wipe path.

12. The method of claim 1, wherein said service element is a cap structure for capping a nozzle array of said printhead, and said conducting said service operation comprises:

bringing the cap structure and the nozzle array into a capping relationship.

13. The method of claim 1, wherein said service station is generally arc shaped.

14. A method for servicing a print bar, comprising:

moving the print bar along a first path away from a printing position adjacent a surface of a drum to a service position away from the surface, the print bar having a page wide array of printheads disposed thereon;

moving a service station carrying an array of printhead service elements through an arc-shaped second path from a rest position to a servicing position, the arc-shaped second path having an axis within the drum;

conducting a service operation with the array of printhead service elements on the array of printheads at the service position.

15. The method of claim 14, further comprising:

moving the service station to a station maintenance position; and servicing the array of printhead service elements.

16. The method of claim 15, wherein said array of printhead elements comprises an array of wipers, and said servicing the array of printhead service elements comprises:

scraping the array of wipers to remove debris or contaminants.

17. The method of claim 16, wherein said scraping the array of wipers comprises:

moving the service station along a scrape path to bring the array of wipers in contact with corresponding ones of an array of scraper elements.

18. The method of claim 17, wherein said scrape path is a linear path parallel to an axis of rotation of said drum.

19. The method of claim 18, wherein the array of printheads are disposed in a staggered arrangement on said print bar, each printhead having a nozzle army length which is less than a page width dimension, and wherein said moving the service station along a scrape path comprises:

moving the service station along a scrape distance less than a length of the print bar, and sufficient to scrape each printhead.

20. The method of claim 15, wherein said array of printhead service elements comprises an array of wipers, and said servicing the array of printhead service elements comprises:

applying a wipe assist fluid to the array of wipers.

21. The method of claim 14, further comprising:

moving the service station along said second path away from said servicing position;

moving the printhead along the first path back to the printing position to accurately reposition the print bars for printing operations.

22. The method of claim 21, wherein said moving the printhead along the first path back to the printing position includes engaging a fixed datum with a registration surface to accurately position the printhead at the printing position.

23. The method of claim 14, wherein said moving the printhead away from the printing position comprises:

moving the printhead in a linear path extending radially from a center axis of the drum.

24. The method of claim 14, wherein said conducting said service operation comprises wiping or capping functions.

25. The method of claim 14, wherein said arc shaped path is concentric to a surface of the drum.

26. The method of claim 14 wherein said service station is arc shaped.

27. A drum printer, comprising:

a rotatable drum having a print medium supporting surface;

a printhead disposed adjacent the supporting surface, the printhead mounted on a print bar support structure;

means for translating and rotating the print bar support structure along a first path between a printing position adjacent said print medium supporting surface and a service position away from said print medium supporting surface, wherein said first path is on a linear path extending through a center axis of the drum;

a print bar service station comprising a print bar service component for performing a service function on the printhead at the service position; and means for moving the service station along an arc shaped second path between a rest position and a print bar position.

28. A drum printer, comprising:

a rotatable drum having a print medium supporting surface;

a printhead disposed adjacent the supporting surface, the printhead mounted on a print bar support structure;

means for moving the print bar support structure along a first path between a printing position and a service position;

a print bar service station comprising a print bar service component for performing a service function on the printhead at the service position;

means for moving the service station along an arc-shaped second path between a rest position and a print bar position, the arc-shaped second path being concentric with the print medium supporting surface of the rotatable drum; and a maintenance system for performing a maintenance operation on said service component.

29. The printer of claim 28, wherein said service component is a wiper, and said maintenance system includes a scraper member for scraping the wiper.

30. The printer of claim 29, wherein said maintenance system further includes a fluid dispenser for applying a fluid to said wiper.

31. The printer of claim 28, wherein said maintenance system is disposed adjacent said second path between said rest position and said servicing position.

32. A drum printer, comprising:

a rotatable drum having a print medium supporting surface;

print bars disposed adjacent the supporting surface, individual print bars having a page wide array of printheads mounted thereon;

a print bar support structure for mounting the print bars;

a print bar actuator for moving the print bar support structure along a first path between a printing position adjacent said print medium supporting surface and a service position away from said print medium supporting surface wherein said first path is on a linear path along a radius extending from a center axis of the drum;

a service station including service components for performing a service function on the print bars at the service position; and a position actuator for moving the service station along an arc-shaped path between a rest position and a station service position.

33. The printer of claim 32, further comprises:

a service station actuator for moving the array of service components along a service path to perform the service function.

34. The printer of claim 32, wherein said service station is arc-shaped, and conforms to said arc-shaped path.

35. The printer of claim 32, wherein each printhead comprises a nozzle array of fluid ejecting nozzles.

36. The printer of claim 32, further comprising a plurality of fixed datums for registering the print bar support structure at the printing position.

37. A drum printer, comprising:

a rotatable drum having a print medium supporting surface;

print bars disposed adjacent the supporting surface, individual print bars having a page wide array of printheads mounted thereon;

a print bar support structure for mounting the print bars;

a print bar actuator for moving the print bar support structure along a linear first path between a printing position and a service position;

a service station including service components for performing a service function on the print bars at the service position;

a position actuator for moving the service station along an arc-shaped path between a rest position and a station service position; and a maintenance system for performing a maintenance operation on said service components.

38. The printer of claim 37, wherein said array of service components includes a wiper, and said maintenance system includes an army of scraper members.

39. The printer of claim 38, wherein said maintenance system further includes an array of fluid dispensers for applying a fluid to said array of wipers.

40. The printer of claim 37, wherein said maintenance system is disposed adjacent said second path between said rest position and said servicing position.

41. A printer system, comprising:

a rotatable drum having a print medium supporting surface;

a printhead disposed adjacent the supporting surface, the printhead mounted on a print bar support structure;

a print bar actuator for moving the print bar support structure along a first path between a printing position adjacent said print medium supporting surface and a service position away from said print medium supporting surface, wherein said first path is on a linear path extending through a center axis of the drum;

a print bar service station comprising a print bar service component for performing a service function on the printhead at the service position; and a service station position actuator for moving the service station along an arc shaped path between a rest position and a print bar servicing position.

* * * * *

UNITED STATES PATENT AND TRADEMARK OFFICE

CERTIFICATE OF CORRECTION

PATENT NO. : 7,229,149 B2
APPLICATION NO. : 10/638508
DATED : June 12, 2007
INVENTOR(S) : Geoff Wotton et al.

It is certified that error appears in the above-identified patent and that said Letters Patent is hereby corrected as shown below:

In column 5, line 64, in Claim 4, after “printhead” delete “service”.

In column 6, lines 4-5, in Claim 5, after “comprises:” delete “scraping the wiper to remove debris or contaminants.”.

In column 7, line 3, in Claim 19, delete “army” and insert -- array --, therefor.

In column 8, line 64, in Claim 38, delete “army” and insert -- array --, therefor.

Signed and Sealed this

Twelfth Day of August, 2008

JON W. DUDAS
*Director of the United States Patent and Trademark Office*